US005514010A

United States Patent [19]

Myer et al.

[11] Patent Number: 5,514,010

[45] Date of Patent: May 7, 1996

[54] SPACER FOR CONNECTOR ASSEMBLY

[75] Inventors: John M. Myer, Millersville; Richard W. Grzybowski, Lebanon, both of Pa.

[73] Assignee: The Whitaker Corporation, Wilmington, Del.

[21] Appl. No.: 331,256

[22] Filed: Oct. 28, 1994

[51] Int. Cl.[6] ..... H01R 13/436

[52] U.S. Cl. ..... 439/752

[58] Field of Search ..... 439/689, 364, 439/752, 701, 953, 686

[56] References Cited

U.S. PATENT DOCUMENTS 5,195,900 3/1993 Kumagai et al. ..... 439/364

5,322,456 6/1994 Yagi et al. ..... 439/752

*Primary Examiner*—Neil Abrams

*Assistant Examiner*—Yong Kim

*Attorney, Agent, or Firm*—Bruce Wolstoncroft

[57] ABSTRACT

A spacer (14) to be retained within a receptacle housing (11) in either a preset position or a final position. The spacer (14) has a pair of blades (17, 18) to be inserted in respective slots (67, 68) in the receptacle housing (11). Each blade (17, 18) provides first and second bumps (29–32) on the internal surface (24, 25) of the blade (17, 18) and these bumps (29–32) engage internal bumps (73–76) in the slots (67, 68) of the receptacle housing (11), such that upon receiving the spacer (14) in the preset position, the first bump (30, 31) on each of the blades (17, 18) prevents the spacer (14) from coming out and the second bump (29, 32) resists inserting the spacer (14) further to the final position. Upon receiving the spacer (14) in the final position, the second bump (29, 32) on each of the blades (17, 18) prevents the spacer (14) from coming out, thereby preventing an accidental insertion and removal of the spacer (14).

9 Claims, 10 Drawing Sheets

SPACER FOR CONNECTOR ASSEMBLY

FIELD OF THE INVENTION

The present invention relates to an electrical connector assembly, and, more particularly, to a spacer in the connector assembly which can be retained on a receptacle housing in two required positions.

BACKGROUND OF THE INVENTION

A typical center jackscrew type connector assembly includes a receptacle housing with electrical contacts therein, which is to be secured to a module connector by means of a bolt. A plastic spacer on a module side of the receptacle housing provides electrical isolation of the electrical contacts loaded into the receptacle housing and also protects the contacts from mechanical damage or other environmental interference. In the process of assembling the connector assembly, the spacer is loosely installed within the receptacle housing for shipping the receptacle housing to a harness maker. After the electrical contacts are loaded into the receptacle housing, the spacer is positioned into its final position, thereby accomplishing assembly of the module side of the receptacle housing.

Disadvantageously, while the electrical housing is being shipped to the harness manufacturer, the spacer may be accidentally pushed into its final position, thereby requiring the harness manufacturer to waste valuable production time in ejecting the spacer. Even if the spacer is intentionally placed into its final position, the spacer may come out, thereby causing a reliability and quality assurance problem.

SUMMARY OF THE INVENTION

It is, therefore, an object of the present invention to provide a spacer for a connector assembly which may be removably secured and retained in one of two desired positions within a receptacle housing.

It is another object of the present invention to provide a spacer which may be inserted into and removed from a desired position in the receptacle housing by applying a predetermined force.

It is still another object of the present invention to provide a receptacle housing which may hold the spacer in one of two desired positions.

The present invention finds its particular utility in combination with a receptacle housing of a center jackscrew type connector system.

According to the teachings of the present invention, the spacer includes a pair of substantially identical blades extending from its front panel to be received in respective slots within the receptacle housing.

Each blade has a first and a second bump provided on its internal surface. Upon receiving the spacer in the preset position, the first bump on each blade prevents the spacer from coming out, while the second bump resists inserting the spacer further. Upon receiving the spacer in the final position thereof, the second bump on each blade maintains the spacer in its final position.

These and other objects of the present invention will become apparent from a reading of the following specification taken in conjunction with the enclosed drawings.

DESCRIPTION OF THE PREFERRED EMBODIMENTS

Figure 1:
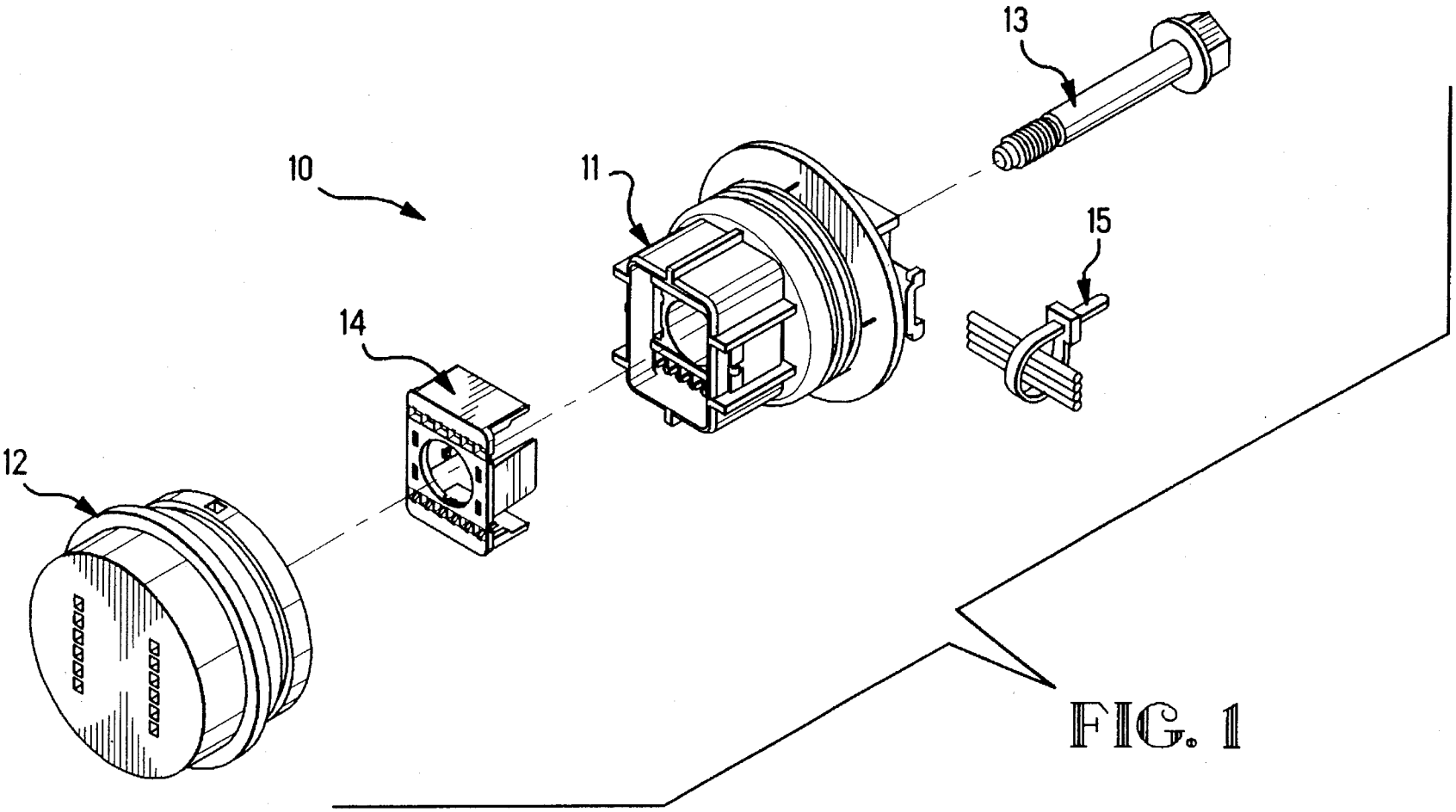
FIG. 1 is a perspective exploded view of a central jackscrew type connector assembly.
Figure 2:
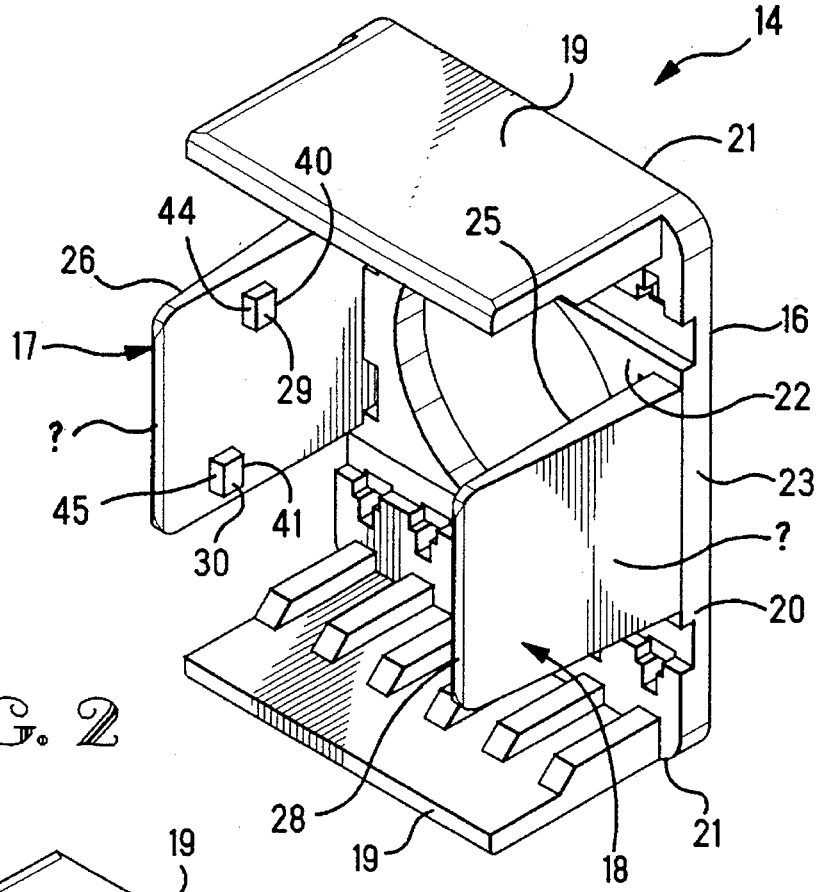
FIG. 2 is a perspective view of the spacer.
Figure 3:
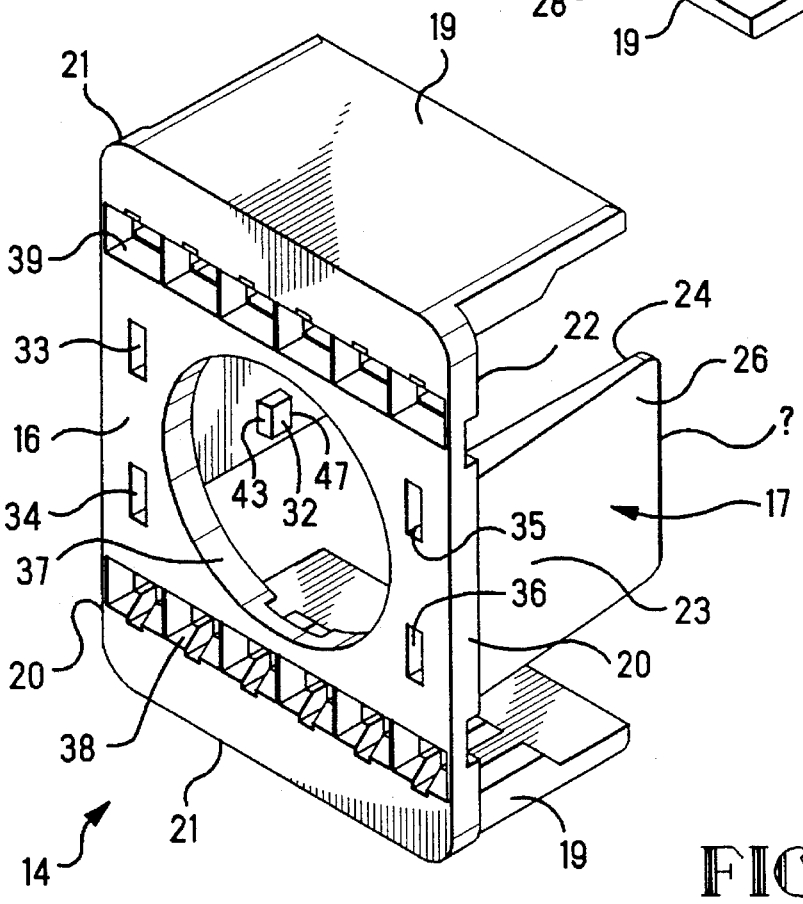
FIG. 3 is another perspective view of the spacer.

Referring to FIG. 1, a connector assembly 10 includes a receptacle housing 11 to be secured to a module connector 12 by a bolt 13, a spacer 14 to be positioned and held within the receptacle housing 11 either in a preset or in a final position, and a plurality of wires 15 to be loaded into the receptacle housing 11.

Figure 4:
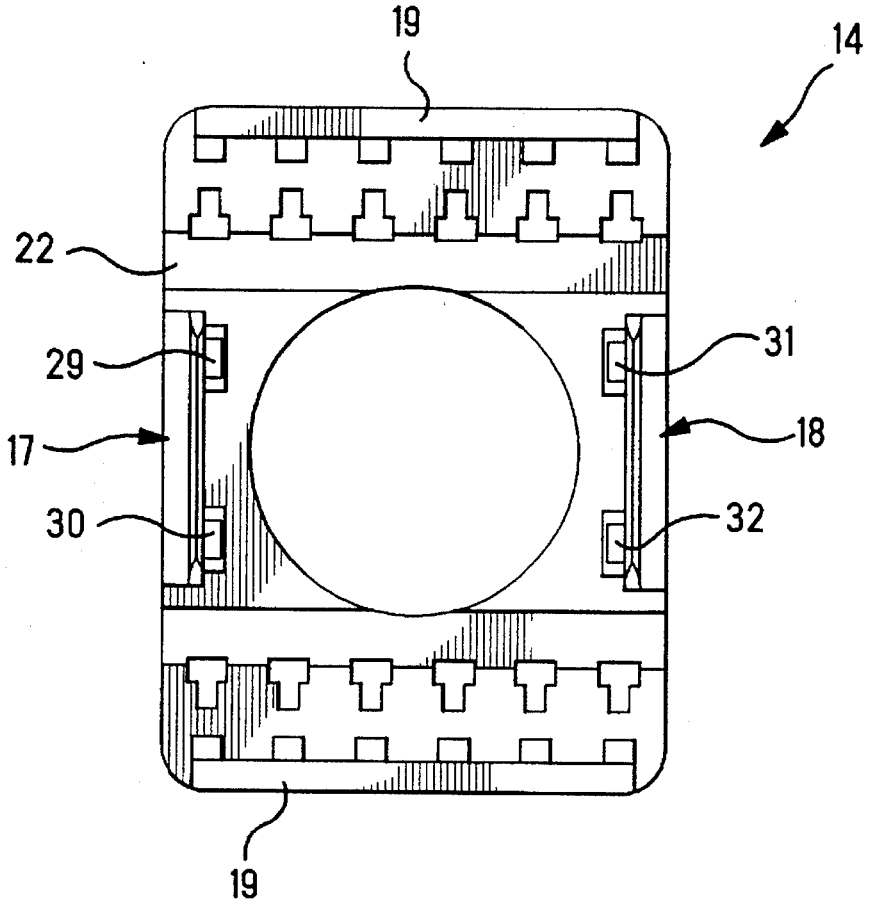
FIG. 4 is a view of the external surface of the front panel of the spacer.
Figure 5:
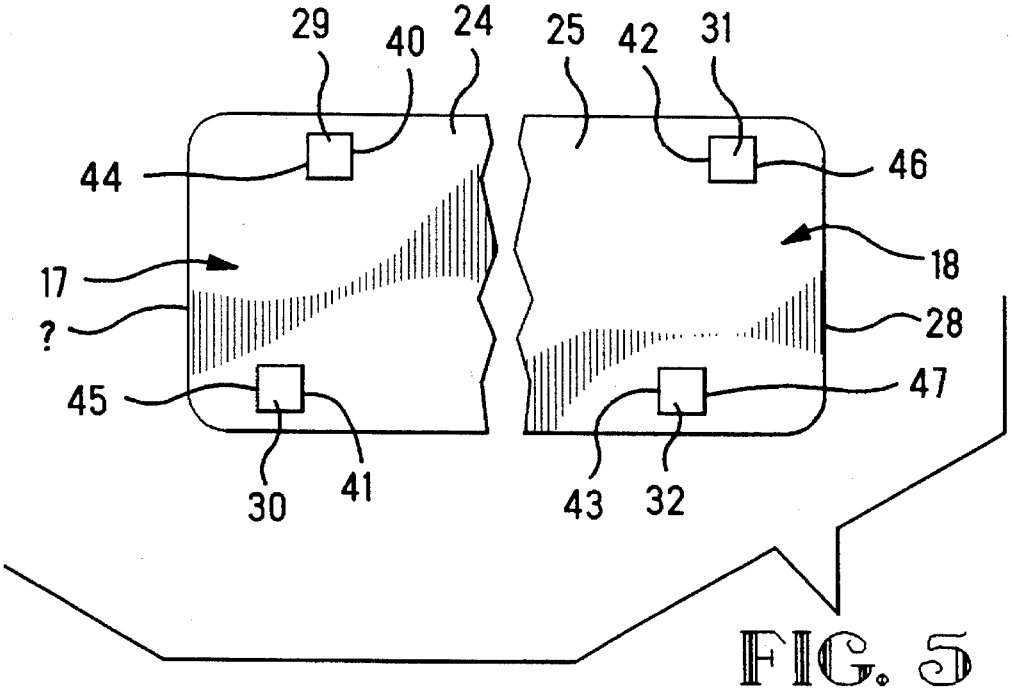
FIG. 5 is a schematic view of the internal surface of the blades with the bumps.
Figure 6:
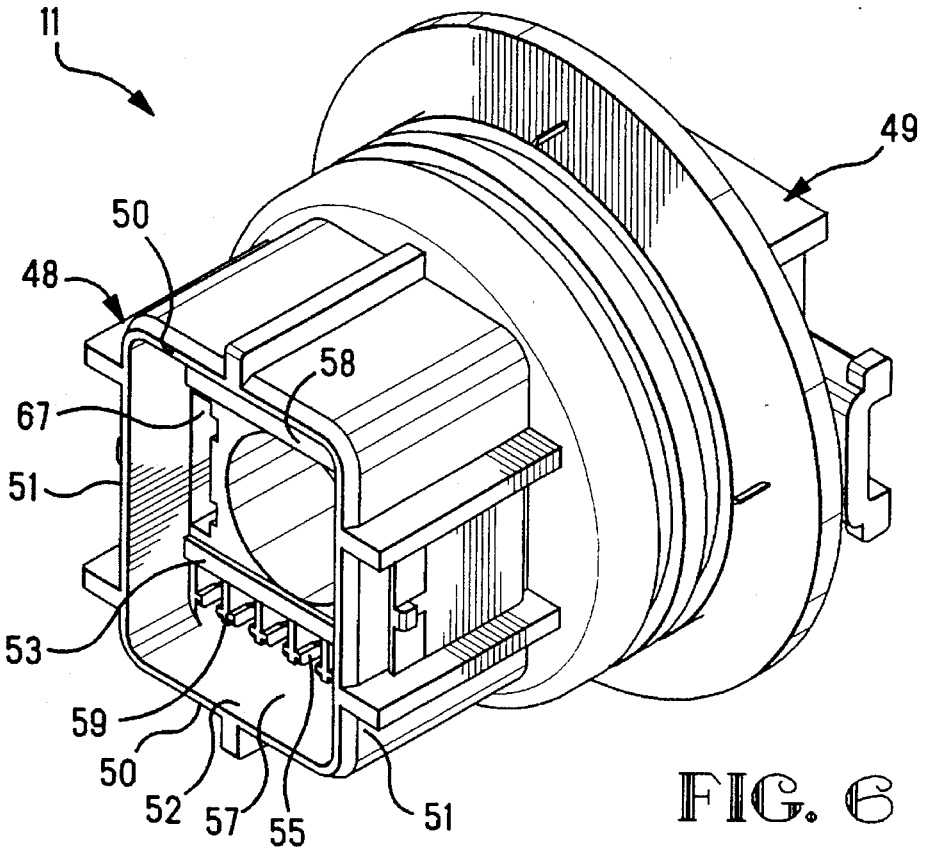
FIG. 6 is an enlarged perspective view of the receptacle housing viewed from the module side.
Figure 7:
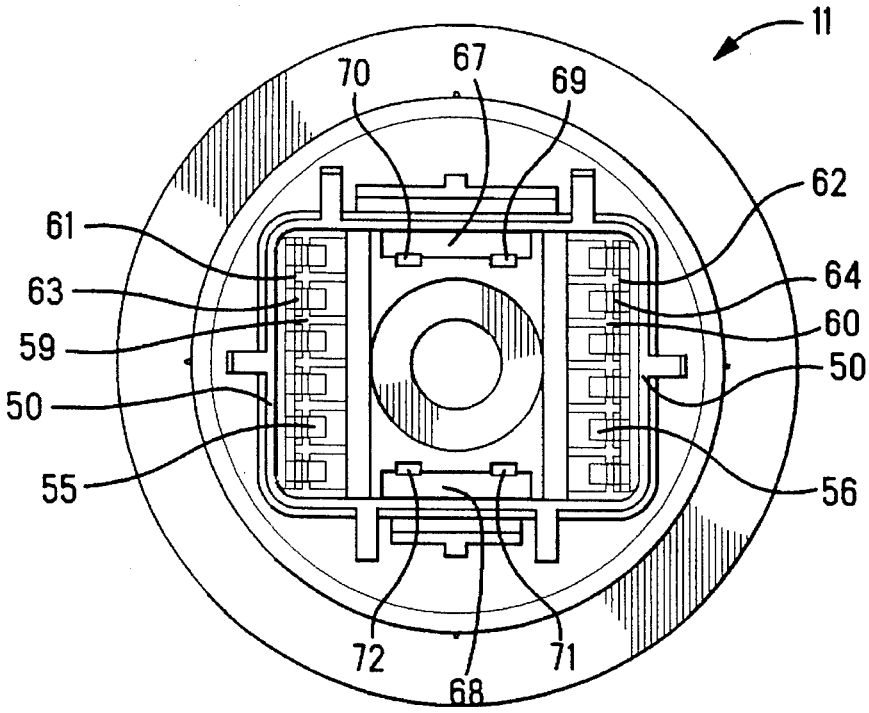
FIG. 7 is a view of the wire side of the receptacle housing.
Figure 8:
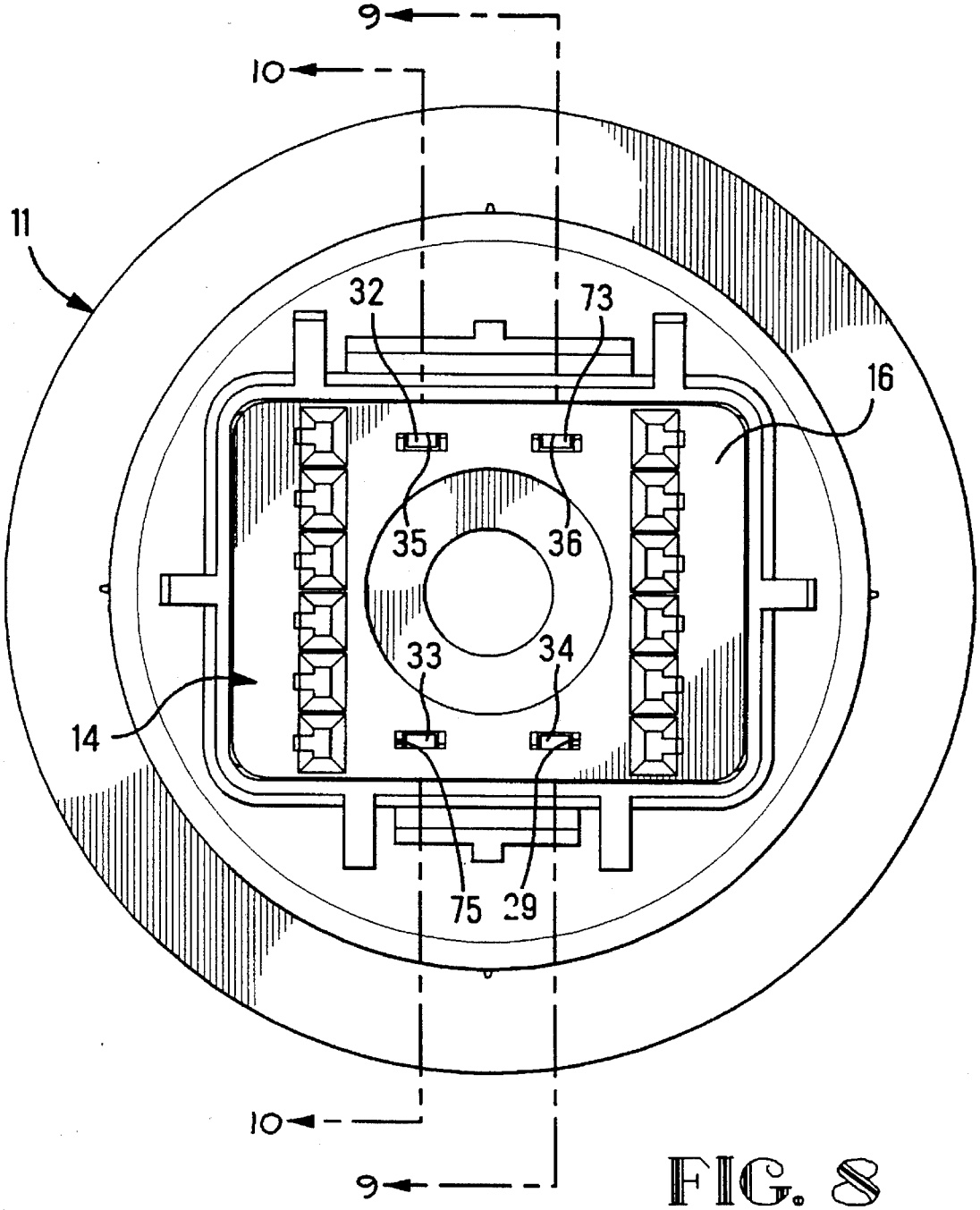
FIG. 8 is a side view of the spacer in the receptacle housing (preset position).
Figure 9:
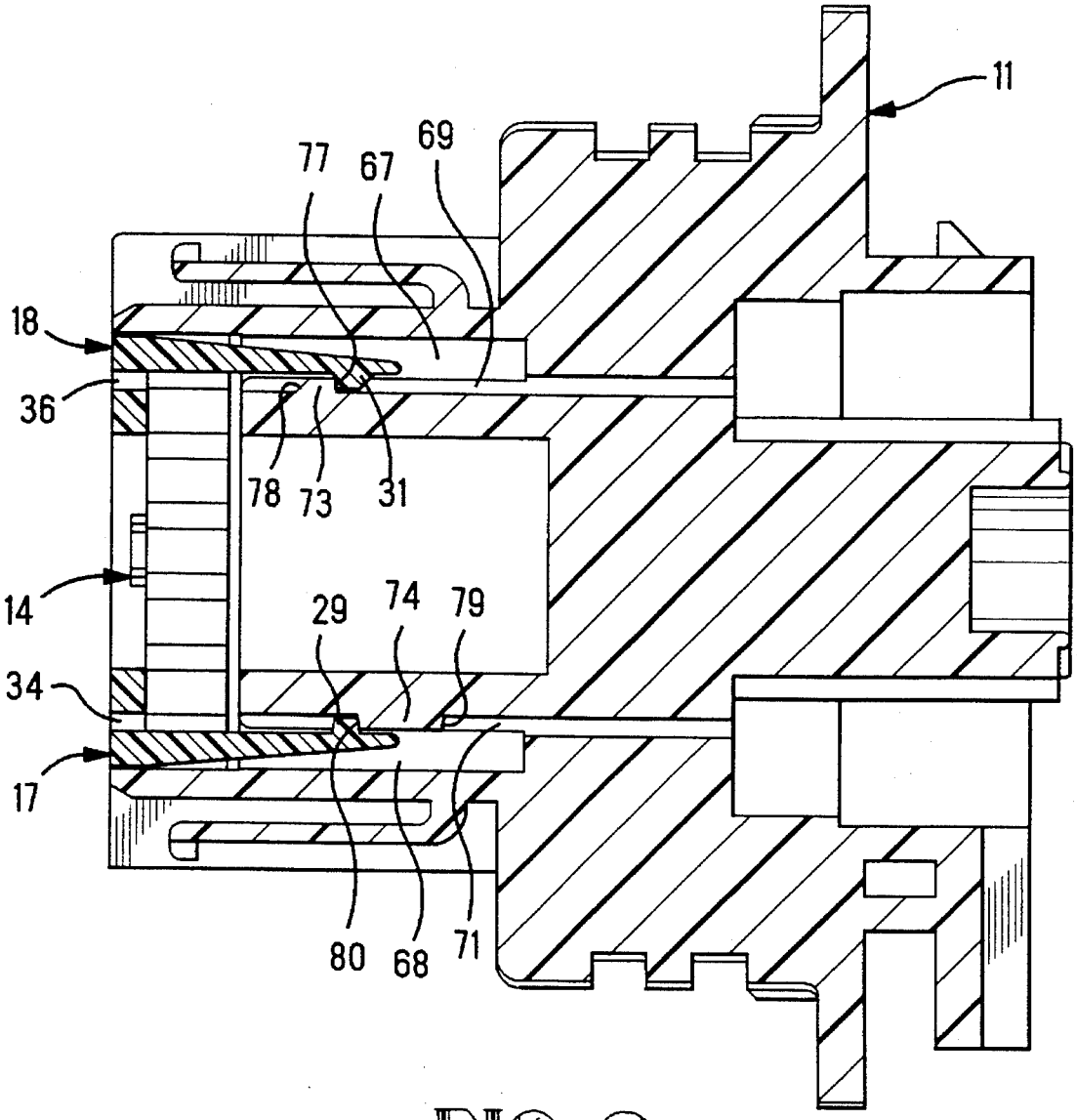
FIG. 9 is an enlarged sectional view of FIG. 8 taken along lines 9—9 thereof.
Figure 10:
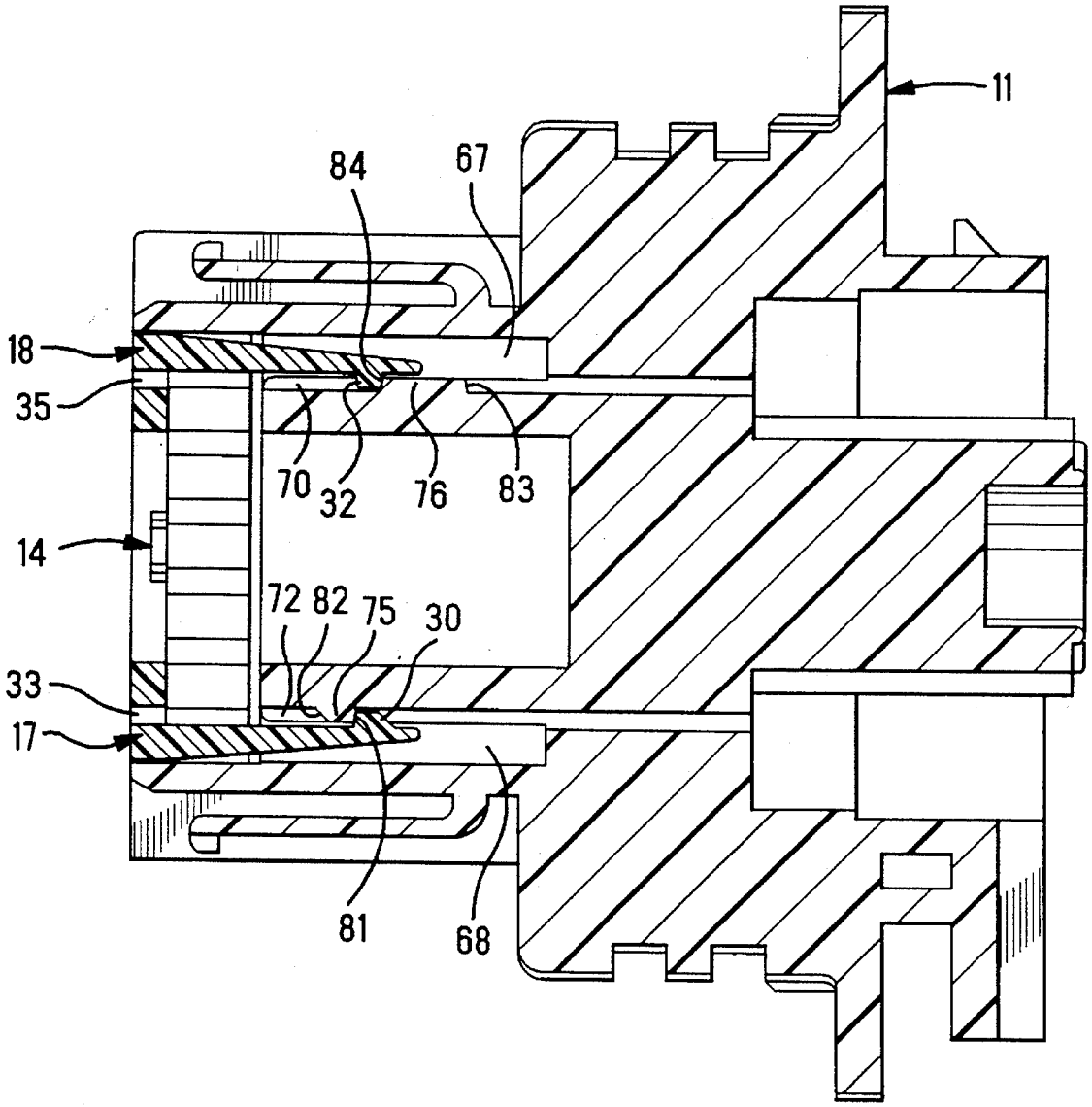
FIG. 10 is an enlarged sectional view of FIG. 8, taken along lines 10—10 thereof.

Referring to FIGS. 2–5, the spacer 14 includes a front panel 16, two substantially identical blades 17 and 18, and two retention tabs 19. The front panel 16 has two spaced-apart parallel sides 20, which are parallel to each other, and two spaced-apart sides 21. Sides 20 and 21 are substantially perpendicular to each other. The front panel 16 also has an internal surface 22 and an external surface 23. Blades 17, 18 extend from the internal surface 22 of the front panel 16 at sides 20. Each blade 17, 18 has an internal surface 24, 25, respectively, and an external surface 26, 26', respectively. Each blade 17, 18 is resiliently mounted on the internal surface 22 of the front panel 16 and may flex or deflect. Each of the blades 17, 18 has a respective edge 27, 28. As best shown in FIGS. 4, 5, a first and a second bump 29, 30, and a first and a second bump 31, 32, are disposed on the internal surface 24, 25 of the blades 17, 18, respectively. The bumps 29, 30 are spaced by a different distance from the edge 27; the bumps 31, 32 are also spaced by different distances from the edge 28. However, the bumps 29 and 32 are spaced by the same distance from their respective edges; similarly, the bumps 30 and 31 are spaced by the same distance from their respective edges. Each bump 29–32 has a respective upper contact surface 40–43, and lower contact surface 44–47, such that the bump 29 has the upper contact surface 40 and the lower contact surface 44, the bump 30 has the upper contact surface 41 and the lower contact surface 45, the bump 31 has the upper contact surface 42 and the lower contact surface 46, and the bump 32 has the upper contact surface 43 and the lower contact surface 47. The front panel 16 also includes holes 33, 34, 35, 36 (FIG. 3), a central substantially round aperture 37, and two rows of opening 38, 39 (which will be discussed below). Referring to FIGS. 6, 7, the receptacle housing 11 includes a module side 48 and a wire side 49. Walls 50 and 51 axially extend from the wire side 49. Walls 50 (or first walls) are spaced apart and in parallel to each other. Walls 51 (or second walls) are spaced apart and in parallel to each other. Each wall 50 is perpendicular to each wall 51, such that the walls 50, 51 form a substantially rectangular opening 52. A wire-carrying body 53 extends out of the wire side 49 within the opening 52 for a length less than a height of the walls 50, 51. In the center of the wire-carrying body 53, a longitudinal cylindrical opening 54 is molded for receiving the bolt 13. The opening 54 is in precise registration with the central aperture 37 on the front panel 16 of the spacer 14. Two rows of slits 55, 56 are located on sides 57, 58 close to the walls 50. The slits 55, 56 are in precise registration with the openings 38, 39 on the front panel 16 of the spacer 14. A plurality of separating walls 59, 60 separate adjacent slits in respective row of these slits 55, 56. Each separating wall 59, 60 has a respective edge 61, 62. Edges 61 form a respective row 63 of these edges 61, such that the row 63 is parallel to the respective wall 50. Similarly, edges 61 form a row 64 parallel to the opposite wall 50. A distance between the rows 63, 64 and their respective walls 50 forming a compartment for receiving the retention tabs 19 on the spacer 14.

Referring again to FIG. 2, each retention tab 19 has a plurality of beams 65 on its internal surface 66. When the spacer 14 is installed into the receptacle housing 11, the beams 65 are received between a pair of respective separating walls 59, 60 to help align electrical contacts.

Figure 11:
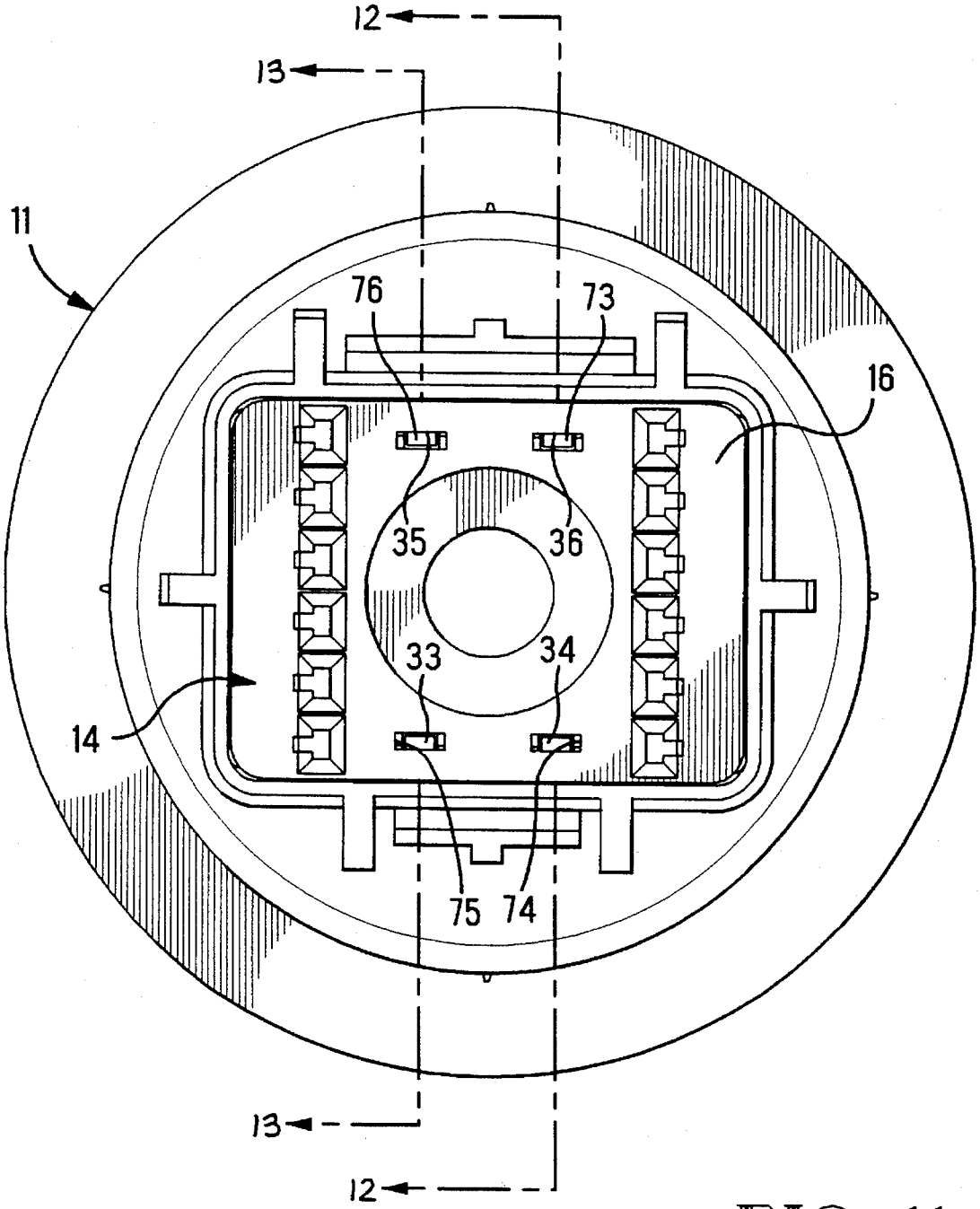
FIG. 11 is a side view of the spacer in the receptacle housing (final position).
Figure 12:
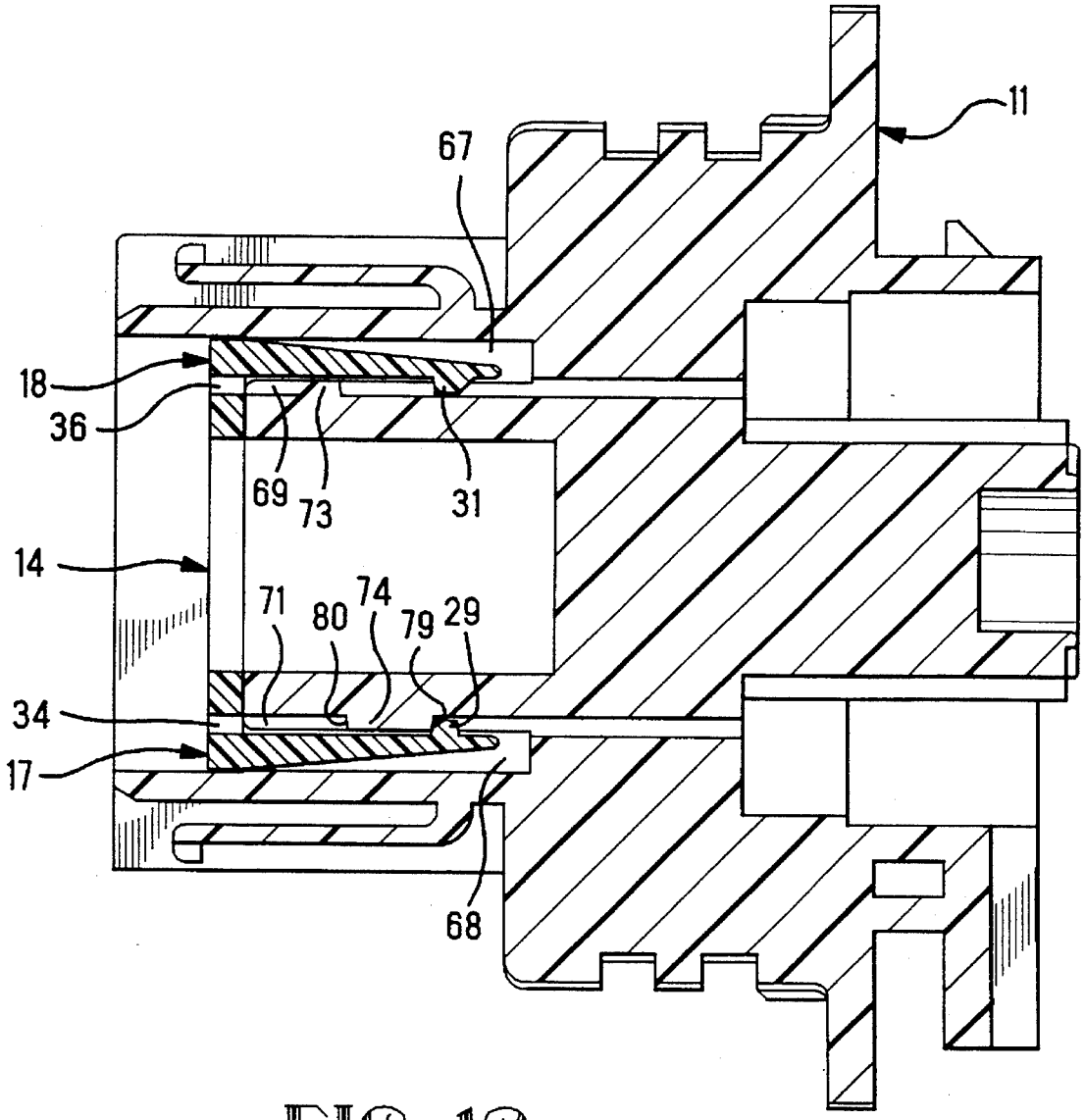
FIG. 12 is an enlarged sectional view of FIG. 11, taken along lines 12—12 thereof.
Figure 13:
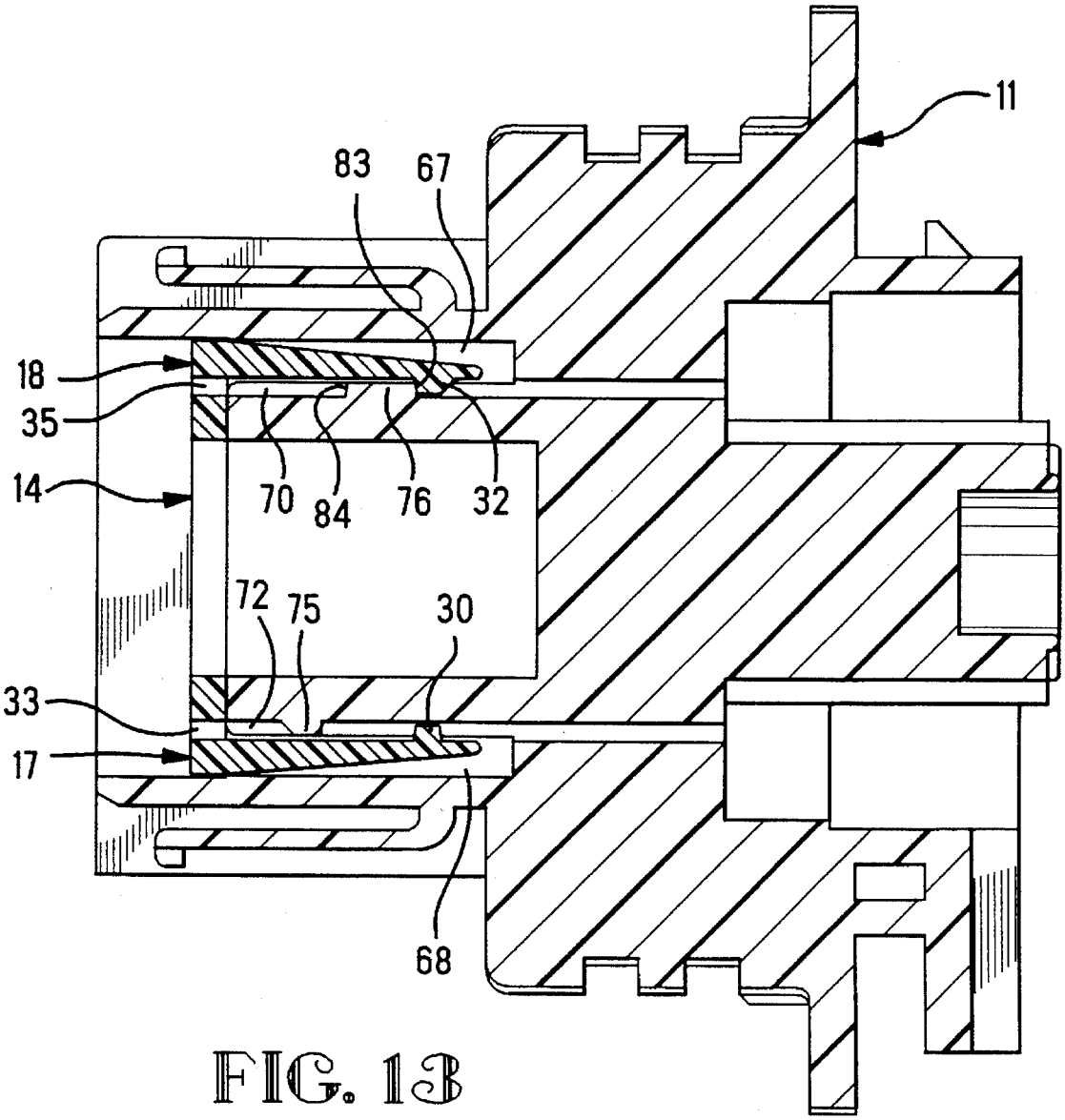
FIG. 13 is an enlarged sectional view of FIG. 11, taken along lines 13—13 thereof.

Referring again to FIGS. 6 and 7 and also to FIGS. 8–11, a pair of slots 67, 68 are formed within the wire carrying body 53 adjacent to respective walls 51. Each slot 67, 68 receives a respective blade 17, 18. The slots 67, 68 extend along the walls 51 by a predetermined length which is sufficient for receiving the blades 17, 18, when the spacer 14 is positioned in the final position (FIGS. 11–13).

Each of the slots 67, 68 has first and second substantially parallel recesses, such that the recesses 69, 70 are formed in the wire-carrying body 53 in the slot 67, and the recesses 71, 72 are formed in the wire-carrying body 53 in the slot 68. The recesses 69–72 extend along the slots for receiving the respective bumps 29–32 of the blades 17, 18, such that the bump 29, 30, 31, 32 are received in the recesses 71, 72, 69, 70, respectively.

Each recess 69–72 has a respective internal bump 73–76. The internal bumps 73 and 75, located in the recesses 69 and 72, respectively, are substantially identical. The internal bumps 74 and 76, located in the recesses 71 and 70, respectively, are also substantially identical. However, the internal bumps 73, 75 differ from the internal bumps 74, 76 in their size along the respective recesses 69–72. Each internal bump 73–76 has its lower and upper engaging surface. The internal bump 73 has the lower 77 and the upper 78 engagement surfaces. Likewise, the internal bump 74 has a lower engagement surface 79 and an upper engagement surface 80; the internal bump 75 has the lower and the upper engagement surfaces 81, 82; and the internal bump 76 has the lower and the upper engagement surface 83, 84, respectively. Each upper and lower engagement surfaces 77–84 are located on a respective depth within the respective recesses, such that the lower engagement surfaces 77, 81 of the internal bumps 73 and 75, and the upper engagement surfaces 80, 84 of the internal bumps 74, 76 are provided on the same respective depth.

When the spacer 14 is located in the preset position (FIGS. 8–10), the lower contact surface 44 of the bump 29 engages the upper engagement surface 80 of the internal bump 74, the lower contact surface 47 of the bump 32 engages the upper engagement surface 84 of the internal bump 76, the upper contact surface 42 of the bump 31 engages the lower engagement surface 77 of the internal bump 73, and the upper contact surface 41 of the bump 30 engages the lower engagement surface 81 of the internal bump 75. Therefore, engagement of bumps 30, 31 with the respective internal bumps 75, 73, prevents the spacer 19 from coming out. Engagement between bumps 29, 32 with the respective internal bumps 74, 76 prevents the spacer 14 from pushing in accidentally.

When the spacer 14 is located in the final position (FIGS. 11–13) within the receptacle housing 11, the lower engagement surface 79 of the internal bump 74 in the recess 71 engages the upper contact surface 40 of the bump 29 and the lower engagement surface 83 of the internal bump 76 in the recess 70 engages the upper contact surface 43 of the bump 32, thereby preventing the spacer 14 from coming out after it has been seated to its final position.

The spacer 14, as described above, provides a "friction lock" between the blades 17, 18 and the receptacle housing 11. The friction lock is accomplished by choosing the proper positive ramp angle on the bumps 29–32 between respective contact surfaces 40–47 of the bumps 29–32 and the respective engagement surfaces 77–84 of the internal bumps 73–76. For example, the positive ramp angle is 8 eight degrees (8°). The spacer 14 and the receptacle housing 11 are reliably retained in either preset or in final mutual interposition to each other. To change the interposition from preset position to final position or vise versa, a certain mechanical force of proper values should be applied. The retention feature of the spacer 14 is strong, provides stiffness to the "friction lock", and can meet these proper values. As a result, the spacer cannot be pushed in or come out accidentally.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In combination with a receptacle housing, a spacer to be positioned and held either in a preset position or in a final position, the spacer comprising:

a front panel, the front panel having at least two spaced-apart opposite sides and an internal and an external surface, respectively, a pair of substantially identical blades extending from the internal surface of the front panel at said two spaced-apart sides, each of said blades including an internal surface, a first and a second bump being disposed on the internal surface of each of said blades, the receptacle housing having respective slots into which said blades are inserted, such that upon receiving the spacer in the preset position, the first bump on each of said blades prevents the spacer from coming out and the second bump resists inserting said spacer further to the final position, and upon receiving the spacer in the final position, the second bump on each of said blades resists the spacer coming out, thereby preventing accidental insertion and removal of the spacer.

2. The spacer of claim 1, wherein said blades are resiliently mounted on the internal surface of the front panel.

3. The spacer of claim 2, wherein each of said blades has an edge spaced apart from the internal surface of the front panel, wherein the first and the second bumps are spaced apart from each other along said edge and wherein the first and the second bumps are spaced from said edge by different distances.

4. The spacer of claim 1, wherein the receptacle housing includes a module side and a wire side, respectively, wherein the module side includes walls axially extending from the wire side and forming a substantially rectangular opening, wherein a wire-carrying body extends out of the wire side within said substantially rectangular opening, said wire-carrying body being extended to a length less than a height of the walls, wherein said wire-carrying body includes a longitudinal cylindrical opening and a first and a second plurality of slits for receiving a plurality of wires on respective sides of said wire-carrying body, and wherein each of the first and the second bump includes a lower and an upper contact surface, respectively, the wire carrying body having a pair of slots formed therein, each adjacent to respective walls on the module side, for receiving one of the blades, said slots extending along said respective walls by a predetermined length sufficient for receiving the blades while the spacer being positioned in the final position, each of said slots having a first and a second substantially parallel recesses, extending the predetermined length of the slots for receiving the first and the second bumps of the blades, respectively, the first and the second recesses having a first and a second internal bump, respectively, each of the first and second internal bumps having an upper and a lower engagement surface, respectively, each engagement surface being provided at a respective depth within the first and second recesses, respectively, and the lower engagement surface of the first internal bump and the upper engagement surface of the second internal bump being provided at the same respective depth, such that in relation to each of said blades:

upon receiving the spacer in the preset position, the upper contact surface of the first bump engages the lower engagement surface of the first internal bump, and the lower contact surface of the second bump engages the upper engagement surface of the second internal bump, and upon receiving the spacer in the final position, the upper contact surface of the second bump engages the lower engagement surface of the second internal bump.

5. The spacer of claim 4, further including a pair of retention tabs, the retention tabs extending from the internal surface of the front panel substantially perpendicular to said blades, said retention tabs being received in the respective slots of the receptacle housing, whereby the retention tabs and said blades retain the connector in the proper position.

6. The spacer of claim 5, wherein the slits for carrying said plurality of wires have respective separating walls, wherein said retention tabs have a plurality of beams on an internal surface of each of said retention tabs, and wherein each beam is received between a pair of separating walls of a respective slit for carrying said plurality of wires.

7. The spacer of claim 4, wherein the front panel includes a central substantially round aperture, and further includes a first and a second plurality of openings, the module side of the receptacle housing having a longitudinal cylindrical opening in precise registration with said substantially round aperture, and said first and second plurality of openings being in precise registration with respective ones of said first and second plurality of slits for receiving a plurality of wires on respective sides of said wire carrying body.

8. The spacer of claim 1, wherein said spacer is made from plastic.

9. In combination with a spacer having a pair of substantially identical spaced apart blades, each having a first and a second bump, said first and second bump having a lower and an upper contact surface, respectively, said spacer being positioned and held either in a preset or in a final position within a receptacle housing, the receptacle housing comprising:

a module side and a wire side, the module side including first and second walls axially extending from the wire side and forming a substantially rectangular opening, said first walls being spaced apart and in parallel to said other, said second walls being spaced apart and in parallel to each other, said first and second walls being perpendicular to each other, a wire-carrying body extending out of the wire side within said substantially rectangular opening, said wire-carrying body being extended to a length less than a height of the walls, said wire-carrying body including a longitudinal cylindrical opening and a first and a second plurality of slits for receiving a plurality of wires on respective sides of said wire-carrying body, the wire-carrying body having a pair of slots formed therein, each adjacent to respective first walls on the module side for receiving one of the blades, said slots extending along said respective walls by a predetermined length sufficient for receiving the blades while the spacer being positioned in the final position, each of said slots having a first and a second substantially parallel recesses, extending said predetermined length of the slots, for receiving the respective first and the second bumps, respectively, the first and the second recesses having a first and a second internal bump, respectively, each of the first and second internal bumps having an upper and a lower engagement surface, respectively, each engagement surface being provided on a respective depth within the first and second recesses, respectively, and the lower engagement surface of the first internal bump and the upper engagement surface of the second internal bump being provided on the same respective depth, such that in relation to each of said blades:

upon receiving the spacer in the preset position, the upper contact surface of the first bump engages the lower engagement surface of the first internal bump and the lower contact surface of the second bump engages the upper engagement surface of the second internal bump, and upon receiving the spacer in the final position, the upper contact surface of the second bump engages the lower engagement surface of the second internal bump.

* * * * *